United States Patent [19]

Chen et al.

[11] Patent Number: 5,068,048

[45] Date of Patent: Nov. 26, 1991

[54] LUBRICANTS AND LUBE ADDITIVES FROM EPOXIDATION OF LOWER OLEFIN OLIGOMERS

[75] Inventors: Catherine S. H. Chen, Berkley Heights; Paul G. Rodewald, Rocky Hill, both of N.J.

[73] Assignee: Mobil Oil Corporation, Fairfax, Va.

[21] Appl. No.: 476,079

[22] Filed: Feb. 7, 1990

[51] Int. Cl.[5] ..... C10M 145/00

[52] U.S. Cl. ..... 252/52 A; 252/56 D; 585/10; 585/12; 585/517; 585/533

[58] Field of Search ..... 585/10, 517, 533; 252/52 A, 56 D

[56] References Cited

U.S. PATENT DOCUMENTS

| | | | |
|---|---|---|---|
| 3,120,547 | 2/1964 | Dieckelmann . | |
| 3,404,163 | 10/1968 | Budde, Jr. et al. . | |
| 3,953,480 | 4/1976 | Delavarenne et al. . | |
| 4,520,221 | 5/1985 | Chen . | |
| 4,568,785 | 2/1986 | Chen et al. . | |
| 4,647,678 | 3/1987 | Eckwert et al. . | |
| 4,658,079 | 4/1987 | Chen . | |
| 4,754,096 | 6/1988 | Chang et al. | 585/12 |
| 4,827,064 | 5/1989 | Wu | 585/10 |
| 4,827,073 | 5/1989 | Wu | 585/10 |
| 4,943,383 | 7/1990 | Avery et al. | 252/52 A |

*Primary Examiner*—Jacqueline V. Howard

*Attorney, Agent, or Firm*—Alexander J. McKillop; Charles J. Speciale; Malcolm D. Keen

[57] ABSTRACT

Oligomers produced from lower olefins by acidic zeolite catalyzed oligomerization can be converted to useful lubricant additives or lubricants by epoxidation of olefinic bonds in the oligomers, whereby oligomers containing oxirane ring structures are produced. The epoxided products so produced exhibit high viscosity index and low pour points. The discovery is particularly applicable to the epoxidation of oligomers produced from lower olefins such as propylene by oligomerization using ZSM-5 catalyst which has been surface deactivated.

8 Claims, No Drawings

LUBRICANTS AND LUBE ADDITIVES FROM EPOXIDATION OF LOWER OLEFIN OLIGOMERS

This invention relates to epoxidized oligomers of lower olefins exhibiting lubricant properties and lubricant additive qualities. In particular, the invention relates to the epoxidation product and process to produce novel olefin oligomers having high viscosity index and low pour point. The invention further relates to mixtures of these novel epoxidized oligomers with mineral oil and synthetic lubricants systems and their utilization of these novel lubricant epoxides as additives for lubricant compositions.

BACKGROUND OF THE INVENTION

Recent work in the field of olefin upgrading has resulted in a catalytic process for converting lower olefins to heavier hydrocarbons. Heavy distillate and lubricant range hydrocarbons can be synthesized over ZSM-5 type catalysts at elevated temperature and pressure to provide a product having substantially linear molecular conformations due to the ellipsoidal shape selectivity of certain medium pore catalysts.

Conversion of olefins to gasoline and/or distillate products is disclosed in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of a ZSM-5 type zeolite. Particular interest is shown in a technique developed by Garwood, et al., as disclosed in European patent application No. 83301391.5, published Sept. 29, 1983. In U.S. Pat. Nos. 4,150,062; 4,211,640 and 4,227,992 Garwood, et al. disclose the operating conditions for the Mobil Olefin to Gasoline/Distillate (MOGD) process for selective conversion of $C_3$+ olefins to mainly aliphatic hydrocarbons.

In the process for catalytic conversion of olefins to heavier hydrocarbons by catalytic oligomerization using a medium pore shape selective acid crystalline zeolite, such as ZSM-5 type catalyst, process conditions can be varied to favor the formation of hydrocarbons of varying molecular weight. At moderate temperature and relatively high pressure the conversion conditions favor $C_{10}$+ aliphatic product. Lower olefinic feedstocks containing $C_2$–$C_8$ alkenes may be converted; however, the distillate mode conditions do not convert a major fraction of ethylene. A typical reactive feedstock consists essentially of $C_3$–$C_6$ mono-olefins, with varying amounts of nonreactive paraffins and the like being acceptable components.

U.S. Pat. Nos. 4,520,221, 4,568,786 and 4,658,079 to C. S. H. Chen, et al., incorporated herein by reference in their entirety, disclose further advances in zeolite catalyzed olefin oligomerization. These patents disclose processes for the preparation of high viscosity index lubricant range hydrocarbons by oligomerization of light olefins using zeolite catalyst such as ZSM-5. The oligomers so produced are essentially linear in structure and contain olefin unsaturation. These unique olefinic oligomers are produced by surface deactivation of the ZSM-5 type catalyst by pretreatment with a surface-neutralizing base.

The formulation of lubricants typically includes an additive package incorporating a variety of chemicals to improve or protect lubricant properties in application specific situations, particularly internal combustion engine and machinery applications. The more commonly used additives include oxidation inhibitors, rust inhibitors, antiwear agents, pour point depressants, detergent-dispersants, viscosity index (VI) improvers, foam inhibitors and the like. This aspect of the lubricant arts is specifically described in Kirk-Othmer "Encyclopedia of Chemical Technology", 3rd edition, Vol. 14, pp. 477–526, incorporated herein by reference. The inclusion of additives in lubricants provides a continuing challenge to workers in the field to develop improved additives of increased compatibility with the lubricant and other additives or new additives containing a multifunctional capability that can reduce the number of additives required in the formulation.

The aforenoted olefinic character of the lower olefin oligomers produced by the ZSM-5 catalyzed processes of Chen, et al., provides a reactive site to modify those unique oligomers to produce derivatives that can exhibit lube additive properties or improvements in lubricant characteristics or improvement in additive solubility in the base stock to avoid the necessity of adding esters as solvents. Olefin epoxidation is one known reaction which can be readily applied to a variety of olefinic compounds. Accordingly, it is an object of the present invention to provide a process for the epoxidation of olefins produced by zeolite catalyzed oligomerization of lower olefins.

It is another object of the present invention to provide novel lubricant additives and lubricants by the epoxidation of olefin oligomers produced from lower olefins by surface deactivated zeolite catalysts.

Yet another object of the instant invention is to provide novel lubricant mixtures from mineral oil and synthetic lubricants derived from polyalphaolefins and containing epoxidized olefin oligomers.

SUMMARY OF THE INVENTION

It has been discovered that the oligomers produced from lower olefins by acidic zeolite catalyzed oligomerization can be converted to useful lubricant additives or lubricants by epoxidation of olefinic bonds in the oligomers, whereby oligomers containing oxirane ring structures are produced. The epoxide products so produced exhibit high viscosity index and low pour points. The discovery is particularly applicable to the epoxidation of oligomers produced from lower olefins such as propylene by oligomerization using ZSM-5 catalyst which has been surface deactivated.

More particularly, an epoxidation reaction product has been discovered comprising the product made by epoxidation of an oligomeric olefin, said olefin comprising the oligomerization product of lower olefin oligomerized in contact with medium pore, shape selective metallosilicate catalyst under oligomerization conditions. The epoxidation reaction is carried out with an epoxidizing agent such as alkyl or aryl percarboxylic acid, hydrogen peroxide, or mixtures thereof. The product comprises a liquid lubricant containing $C_{20}$+ carbon atoms and having a viscosity at 100° C. greater than 2 cS and viscosity index measured at 100° C. greater than 75.

The invention further comprises a process for the production of liquid lubricant or lubricant additive by contacting an oligomeric olefin and an epoxidizing agent under epoxidizing conditions. The olefin comprises the oligomerization product of lower olefin oligomerized in contact with medium pore, shape selective metallosilicate catalyst, such as ZSM-5, under oligomerization conditions.

The epoxidation reaction product is separated and the liquid lubricant or additive containing oxirane ring structure is recovered.

The invention also pertains to liquid lubricant compositions comprising a mixture of a liquid hydrocarbon lubricant and the lubricant additive made according to the foregoing process. The mixtures may further contain lubricant additives taken from the group consisting of dispersants, detergents, viscosity index improvers, extreme pressure/antiwear additives, antioxidants, pour point depressants, emulsifiers, demulsifiers, corrosion inhibitors, antirust inhibitors, antistaining additives, friction modifiers, and the like.

DETAIL DESCRIPTION OF THE INVENTION

The epoxidation of olefins is a well known reaction as described in chapter 7, "Synthetic Organic Chemistry", by Wagner & Zook, 1956, published by John Wiley & Sons,Inc.,incorporated herein by reference. Typical epoxidizing agents are alkyl and aryl percarboxylic acids and hydrogen peroxide. Any of several commonly used epoxidation methods can be advantageously used in this invention.

Epoxidized hydrocarbon oils are known and have been used in lubricating oils. However, the epoxides of the present invention described herein are derived from unique oligomeric olefins prepared by a novel process and are therefore themselves unique. Furthermore, the epoxide functional group can serve as an intermediate for preparation of a variety of derivatives such as monoalcohols by epoxide ring reduction or for preparation of diols, amines or betahydroxy mercaptans by epoxy or oxirane ring opening reactions well known in the art. For example, the oxirane ring can be reacted with ethylene oxide to produce a hydrocarbonethylene oxide block co-oligomer which should have lube properties of both polyalphaolefins and polyethylene glycol, or polypropylene glycol.

The novel epoxy functionalized lubricants of the present invention may also be incorporated as blends with other lubricants and polymer systems in quantities ranging from 0.1 to 100% or may, themselves, be used as additives or in substitution for conventional additives. Lubricants and polymer systems which can be blended with the epoxy functionalized lubricants include: mineral oil comprising $C_{30}+$ hydrocarbons; polyolefins and hydrogenated polyolefins comprise polyisobutylene, polypropylene and polyalphaolefins (PAO).

The olefin oligomers used as starting material in the present invention are prepared from $C_3$–$C_{10}$ olefins according to the methods presented by Chen, et al., in the patents cited as references above. Shape-selective oligomerization, as it applies to conversion of $C_3$–$C_{10}$ olefins over ZSM-5, is known to produce higher olefins up to $C_{30}$ and higher. Reaction conditions favoring higher molecular weight products are low temperature (200°–260° C.), elevated pressure (about 2000 kPa or greater) and long contact times (less than 1 WHSV). The reaction under these conditions proceeds through the acid catalyzed steps of oligomerization, isomerization-cracking to a mixture of intermediate carbon number olefins, and interpolymerization to give a continuous boiling product containing all carbon numbers. The channel system of ZSM-5 type catalysts impose shape selective constraints on the configuration of large molecules, accounting for the differences with other catalysts.

The shape-selective oligomerization/polymerization catalysts preferred for use herein to prepare the olefin oligomers used as starting material in the invention include the crystalline aluminosilicate zeolites having a silica to alumina molar ratio of at least 12, a constraint index of about 1 to 12 and acid cracking activity of about 50–300. Representative of the ZSM-5 type zeolites are ZSM-5, ZSM-11, ZSM-12, ZSM-23, ZSM-35 and ZSM-38. ZSM-5 is disclosed and claimed in U.S. Pat No. 3,702,886 and U.S. Pat. No. Re. 29,948; ZSM-11 is disclosed and claimed in U.S. Pat. No. 3,709,979. Also, see U.S. Pat. Nos. 3,832,449 for ZSM-12; 4,076,842 for ZSM-23; 4,016,245 for ZSM-35; and 4,046,839 for ZSM-38. The disclosures of these patents are incorporated herein by reference. A suitable shape selective medium pore catalyst for fixed bed is a small crystal H-ZSM-5 zeolite (silica:alumina ratio=70:1) with alumina binder in the form of cylindrical extrudates of about 1–5 mm. Unless otherwise stated in this description, the catalyst shall consist essentially of ZSM-5, which has a crystallite size of about 0.02 to 0.05 micron. Other pentasil catalysts which may be used in one or more reactor stages include a variety of medium pore siliceous material disclosed in U.S. Pat. Nos. 4,414,423 and 4,417,088, incorporated herein by reference.

The acid catalysts are deactivated by pretreatment with a surface-neutralizing base, as disclosed by Chen in the patents incorporated by reference.

The desired olefinic oligomerization-polymerization products include $C_{10}+$ substantially linear aliphatic hydrocarbons. The ZSM-5 catalytic path for propylene feed provides a long chain with approximately one lower alkyl (e.g., methyl) substituent per 8 or more carbon atoms in the straight chain. The lubricant range product can be depicted as a typical linear molecule having a sparingly-substituted long carbon chain.

Olefinic oligomer lube range materials can be obtained in accordance with the present invention in a single stage or two-stage process. Generally, in two stage process the first stage involves oligomerization of an inexpensive lower olefin of, e.g., propylene at about 200° C. over a surface poisoned HZSM-5. The second stage involves further oligomerization/interpolymerization of the product (or a fraction of the product) from the first stage over a second and/or different acid catalyst, which may be modified or unmodified as disclosed herein, at about 100°–260° C. The temperature of the second state, i.e., about 25°–75° C. lower and preferably the catalyst is an unmodified ZSM-5 type catalyst. Both high yields and high VI are achieved by this two-stage process. In a single stage process only the first stage of the two stage process is employed. Lubes of extremely high VI are produced but at lower yield.

Conventional temperatures, pressures and equipment may be used in the oligomerization process. Preferred temperatures may vary from about 100° to about 350° C., preferably 150° to 250° C. pressures from about atmospheric to 20,000 kPa (3000 psi) and WHSV from about 0.01 to about 2.0, preferably 0.2 to 1.0 are employed.

The process of the present invention involves reaction of oligomeric olefins via epoxidation with performic acid or m-chloroperbenzoic acid to produce the corresponding epoxy functionalized oligomer. Lube range olefins may be utilized or olefins with molecular weights below lube range can be converted into lube range material by epoxidation alone or followed by further oligomerization through the oxirane ring to form ether linkages between hydrocarbon chains. These materials show increased viscosity and somewhat reduced viscosity index and have potential as traction fluids due to presence of the oxirane ring structure. They show utility directly as additives to lubricating oils or indirectly as reactive intermediates for the production of further additives.

The epoxidation reaction can be carried out at temperatures from −20° C. to 250° C. and at subatmospheric, atmospheric or supra-atmospheric pressures. Preferably, the reaction is carried out batchwise by the addition of the epoxidizing agent to a solution of the olefin in a solvent such as dichloromethane with rapid stirring. The epoxide may also be added in solution using the same or other solvents. The product is isolated by conventional means to provide the epoxidized oligomer in high yield. Infrared analysis of the product shows epoxide absorption at 1250cm$^{-1}$.

The following Examples are provided to illustrate the process of the present invention for the epoxidation of olefinic oligomers prepared as described herein:

EXAMPLE 1

Epoxidation of olefins having the average composition $C_{25}H_{50}$ is carried out using performic acid at 23° C. To a rapidly stirred mixture of olefin (17.53 g, 0.0500 mole) in 15 cc hexane and 30% hydrogen peroxide (7.94 g, 0.0700 mole) is added dropwise 89% formic acid (1.29 g, 0.025 mole). The isolated product weighs 17.91 g and shows an epoxide absorption at 1250 cm$^{-1}$ in its infrared spectrum. The following table compares the viscometric properties of the starting olefin with those of the epoxidized product.

| | Fresh | Epoxidized |
|---|---|---|
| Viscosity (cS) at 100° C. | 2.8 | 3.2 |
| Viscosity Index (100° C.) | 93 | 83 |

EXAMPLE 2

Epoxidation of olefins having the average composition $C_{25}H_{50}$ is carried out using m-chloroperbenzoic acid at 25° C. To a rapidly stirred solution of olefin (17.53 g, 0.0500 mole) in 25 cc dichloromethane is added dropwise a solution of m-chloroperbenzoic acid (8.63 g, 0.0500 mole) in 100 cc dichloromethane. The isolated product weighs 16.90 g and shows an epoxide peak at 1250 cm$^{-1}$ in its infrared spectrum, and contains 5.04% oxygen by elemental analysis. The following table compares the viscometric properties of the starting olefin with those of the epoxidized product.

| | Fresh | Epoxidized |
|---|---|---|
| Viscosity at 100° C. | 2.8 | 3.5 |
| Viscosity Index (100° C.) | 93 | 76 |

EXAMPLE 3

Epoxidation of olefins having the average composition of $C_{35}H_{70}$ is carried out using m-chloroperbenzoic acid at 25° C. To a rapidly stirred solution of olefin (24.55 g, 0.0500 mole) in 25 cc dichloromethane is added dropwise a solution of m-chloroperbenzoic acid (8.63 g, 0.0500 mole) in 100 cc dichloromethane. The isolated product weighs 25.12 g, and has an epoxide peak at 1256 cm$^{-1}$ in its infrared spectrum it contains 1.38% oxygen by elemental analysis. The following table summarizes the viscometric properties of the starting olefin with those of the epoxidized product.

| | Fresh | Epoxidized |
|---|---|---|
| Viscosity at 100° C. | 5.5 | 6.1 |
| Viscosity Index (100° C.) | 132 | 125 |

It has been determined that the epoxidized product of the instant invention produce novel lubricant mixtures when mixed with the hydrocarbon lubricants known in the art, including mineral oil and synthetic lubricants such as those derived from the oligomerization of alpha-olefins in contact with cationic and Ziegler catalyst. The epoxidized oligomers can be added to the lubricants in amounts ranging from 0.1% to 99% by mixing.

While the instant invention has been described by specific examples and embodiments, there is no intent to limit the inventive concept except as set forth in the following claims.

What is claimed is:

1. A process for the production of liquid lubricant or lubricant additive comprising;

contacting an oligomeric olefin and an epoxidizing agent under epoxidizing conditions, said olefin comprising the oligomerization product of lower olefin oligomerized in contact with medium pore, shape selective metallosilicate catalyst under oligomerization conditions;

separating the epoxidation reaction product and recovering said liquid lubricant or additive containing oxirane ring structure.

2. The process of claim 1 wherein said epoxidizing agent is alkyl or aryl percarboxylic acid, hydrogen peroxide, or mixtures thereof.

3. The process according to claim 1 wherein said liquid lubricant contains $C_{20}$+ carbon atoms having a viscosity at 100° C. greater than 2 cS and viscosity index measured at 100° C. greater than 75.

4. The process according to claim 1 wherein said metallosilicate catalyst comprises ZSM-5 catalyst.

5. The process according to claim 4 wherein the surface of said catalyst is rendered substantially inactive for acid reactions by treatment with a surface deactivating agent.

6. A liquid lubricant composition comprising a mixture of a liquid hydrocarbon lubricant and from 0.1 to 99 percent of the lubricant additive made according to the process of claim 1.

7. The composition of claim 6 wherein said liquid hydrocarbon lubricant includes mineral oil and polyalphaolefin lubricants.

8. The mixture of claim 7 further comprising lubricant additives taken from the group consisting of dispersants, detergents, viscosity index improvers, extreme pressure/antiwear additives, antioxidants, pour depressants, emulsifiers, demulsifiers, corrosion inhibitors, antirust inhibitors, antistaining additives, friction modifiers, and the like.

* * * * *